US006536147B1

(12) United States Patent
Funk et al.

(10) Patent No.: US 6,536,147 B1
(45) Date of Patent: Mar. 25, 2003

(54) PANEL DISPLAY SYSTEM WITH WIRE MANAGEMENT

(75) Inventors: William Funk, Eagan, MN (US); Timothy Cota, Bloomington, MN (US); Paul N. Sperl, Bloomington, MN (US); Dixon Gimpel, Richfield, MN (US)

(73) Assignee: Skyline Displays, Inc., Eagan, MN (US)

( * ) Notice: Subject to any disclaimer, the term of this patent is extended or adjusted under 35 U.S.C. 154(b) by 0 days.

(21) Appl. No.: 09/556,381

(22) Filed: Apr. 24, 2000

(51) Int. Cl.[7] ..... G09F 7/00
(52) U.S. Cl. ..... 40/605; 52/220.7
(58) Field of Search ..... 40/605, 606, 559; 52/220.1, 220.7, 239; 160/135

(56) References Cited

U.S. PATENT DOCUMENTS

| | | | |
|---|---|---|---|
| 2,962,407 | A | 11/1960 | Aykanian |
| 3,090,078 | A | 5/1963 | Ackles |
| 3,161,911 | A | 12/1964 | Mathews |
| 3,389,196 | A | 6/1968 | Stahl |
| 3,410,931 | A | 11/1968 | Johnson |
| 3,560,285 | A | 2/1971 | Schroter et al. |
| 3,589,755 | A | 6/1971 | King |
| 3,630,819 | A | 12/1971 | Conger |
| 3,668,031 | A | 6/1972 | Bast |
| 3,777,435 | A | 12/1973 | Perina |
| 3,826,206 | A | 7/1974 | Ruggles |
| 3,834,967 | A | 9/1974 | Lowery et al. |
| 3,959,050 | A | 5/1976 | Hooper, Jr. |
| 4,025,687 | A | 5/1977 | Wooler et al. |
| 4,036,923 | A | 7/1977 | Saidla |
| 4,437,275 | A | 3/1984 | Zeigler |
| 4,438,166 | A | 3/1984 | Gluck et al. |
| 4,462,196 | A | 7/1984 | Freiberg |
| 4,480,715 | A | 11/1984 | Brooks |
| 4,493,748 | A | 1/1985 | Cross |

(List continued on next page.)

*Primary Examiner*—Brian K. Green
(74) *Attorney, Agent, or Firm*—Patterson, Thuente, Skaar & Christensen

(57) ABSTRACT

A portable display formed of a plurality of assembleable panels having wire management permitting concealment of wire for powering accessories within the junctures between panels. In a preferred embodiment, the panel edges have edge portions formed with outwardly facing channels defining or including wire conduits. Panel connector portions, either of the sliding type, or the peg or plug-in type secure the panels together to form the display. In a preferred embodiment, each panel has four corners each with corner components that engage with the edge portions, preferably by insertion into receiving openings in said edge portions. Said corner components having a receptacle exposed at each corner to permit either connection with plug-in components, for example, panel connectors for vertical stacking of panels or with accessory brackets. The panel connectors having a U-shaped portion consistent with the wire management characteristics of the invention that that allows the wire conduit to extend through said connectors. Thus attachment of electric powered accessories with concealed power lines is provided.

14 Claims, 6 Drawing Sheets

U.S. PATENT DOCUMENTS 4,543,145 A 9/1985 Schnell et al.
4,631,881 A * 12/1986 Charman ..... 160/135 X
4,712,336 A 12/1987 Backer
4,716,698 A * 1/1988 Wilson et al. ..... 52/220.7 X
4,726,973 A 2/1988 Thompson
4,727,994 A 3/1988 Beaulieu
4,823,858 A 4/1989 Perutz
4,828,897 A 5/1989 Staneluis et al.
4,967,531 A 11/1990 Giles et al.
5,069,263 A 12/1991 Edwards
5,089,189 A 2/1992 Staneluis et al.
5,092,385 A 3/1992 Beaulieu
5,097,643 A 3/1992 Wittler
5,114,510 A 5/1992 Wright
5,160,772 A 11/1992 Futami et al.
5,295,341 A 3/1994 Kajiwara
5,295,342 A 3/1994 Roche et al.
5,305,567 A 4/1994 Wittler
5,318,734 A 6/1994 Palmersten et al.
5,325,649 A 7/1994 Kajiwara
5,343,665 A 9/1994 Palmersten
5,472,365 A 12/1995 Engel
5,502,939 A 4/1996 Zadok et al.
5,537,766 A * 7/1996 Nickers et al. ..... 40/610 X
5,546,720 A 8/1996 LaBruzza
5,561,960 A 10/1996 Minnick et al.
5,626,926 A 5/1997 Roberts
5,642,557 A 7/1997 Clews
5,685,113 A * 11/1997 Reuter et al. ..... 52/239 X
5,857,304 A 1/1999 Karten et al.
5,882,776 A 3/1999 Bambara et al.
5,910,350 A 6/1999 Loracks et al.
5,916,672 A 6/1999 Reeves et al.
5,921,047 A 7/1999 Walker
5,970,675 A 10/1999 Schray
5,974,713 A * 11/1999 Wu ..... 40/605 X
6,047,509 A * 4/2000 Savoie ..... 403/401 X
6,253,509 B1 * 7/2001 Hellwig et al. ..... 52/220.7 X

* cited by examiner

PANEL DISPLAY SYSTEM WITH WIRE MANAGEMENT

BACKGROUND OF THE INVENTION

This invention relates to a portable panel display system in which individual display panels may be assembled together in various configurations. The invention also relates to methods of construction of such display systems.

Display panels are widely used in reception areas, trade shows, museums, art exhibits, academic and research society meetings, advertising displays and the like where visual information is temporarily displayed. The faces of these panels may incorporate soft materials (e.g., cork or fabric), laminates, and magnetic materials for temporarily attaching the visual information to the panels. Often such panels will have rigid surfaces with graphics that extend from panel to adjacent panel. In these display arrangements it is important that adjacent panels are secured together without gaps therebetween that can interrupt and distract the viewer from the image or graphic displayed.

It is also desirable that the panel system may be quickly and easily assembled and disassembled to accommodate a variety of display sizes and configurations, storage, and transportation to another site. It is also desirable that these display panels be securely connected so that display structures are safe. Such panels should also be light in weight to further facilitate assembly and to further provide a safer display.

In various applications it is common and highly desirable to have lighting or other powered accessories included as part of the overall display typically elevated and supported by said display. Such accessories will require electric power and thus wiring to such accessories. Exposed wiring from power outlets or other power sources can be visually distracting and can be hazardous. Typically portable displays and the panels in such displays have had minimal provisions to accommodate such wiring and to conceal such wiring.

SUMMARY OF THE INVENTION

In a preferred embodiment, a portable display is formed of a plurality of assembleable panels, each of such panels having a plurality of edge portions secured together with corner connectors to form a rectangular framework. Panelar sheet material extends over two sides of the framework and polyurethane foam in injected into the interior space. Panel connector portions, either of the sliding type, or the peg or plug-in type secure the panels together to form the display. In a preferred embodiment, each panel has a plurality of corners each with corner components that engage with the edge portions, preferably by insertion into receiving openings in said edge portions to form a framework. Said corner components having a receptacle exposed at each corner to permit either connection with plug-in components, for example, panel connectors for vertical stacking of panels or accessory brackets. The panel connectors having a U-shaped portion consistent with the wire management characteristics of the invention that allows a wire to be extended through same permitting attachment of electric powered accessories with concealed power lines.

Preferred embodiments of the individual display panels may be formed of a framework of extruded aluminum or other rigid materials. The framework comprised of individual sections defining edge portions and having an I-shaped cross section whereby each edge portion has opposite facing channels. The edge portions each having two opposite ends with end surfaces normal to the length of portions. Each edge portion having one channel facing outwardly and another facing inwardly. Adjacent edge portions are joined in an abutting of their respective ends at each corner to form two vertical channeled edge portions and two horizontal channeled edge portions. Each corner of the panel having corner components preferably each having a T-shape with the lower leg of the T positioned horizontally and inserted into an inwardly facing channel of one of the horizontal channeled edge portion. The two upper aligned T-legs are positioned vertically in the inwardly facing channels of the vertical channeled edge portions whereby one of the aligned T-legs of each corner component faces vertically upward or downward and defines an exposed portion with a receptacle.

In a preferred embodiment, the exposed portion of the corner component has a receptacle for receiving plug-in components. Said plug-in components may constitute vertical connector component or feet. The vertical connector components extend between receptacles of adjacent stacked display panels securing same together. In a preferred embodiment said vertical connector portions have different male portions to be received in the receptacles to accomplish different functions. For example, one configuration will have a U-shape to allow the wire conduit defined by the channel to extend therethrough. Another male portion may have a closed solid male portion with detents that securely lock the vertical connector portion into the receptacle.

The framework as described above may be placed in a press with suitable panelar sheets, such as high pressure laminates, spanning the front and back of the framework. A flowable curable material will be injected or placed in the interior space defined by the framework and sheets and allowed to fill said space, for example, polyurethane foam. The corner components each have a secure fit within the edge portions and have a tortuous air vent placed at the interface between the corner component and one or both of the adjoined edge portions. The air vent is appropriately sized and configured such that as the fill material, i.e. expanding urethane foam, reaches restrictions in the vent it clogs the vent minimizing or eliminating excess fill material from escaping from the framework. Expanding polyurethane or similar expansive fill materials may be slightly pressurized from said clogging which will facilitate complete and secure bonding of the urethane to all framework components and the panelar sheets as well as contributing to improved structural strength.

A feature and advantage of the system is that the corner portions have multiple synergistic functions and are of a relatively uncomplicated configuration permitting inexpensive manufacture. Each corner component, in preferred embodiments, are utilized to secure and align the respective edge portions of the framework at the respective corner. Further each corner component provides a receptacle for plug-in components such as vertical connector portions or feet. Moreover, each corner component may provide an air vent with a tortuous path that facilitates the filling of the interior space of the framework with polyurethane foam. Moreover, each corner component has a wire conduit therethrough and further accommodates plug-in components that are compatible with said wire conduit.

BRIEF DESCRIPTION OF THE DRAWINGS

FIG. 7 is a perspective view of a sliding connector in accordance with the invention.

DETAILED DESCRIPTION

Figure 1:
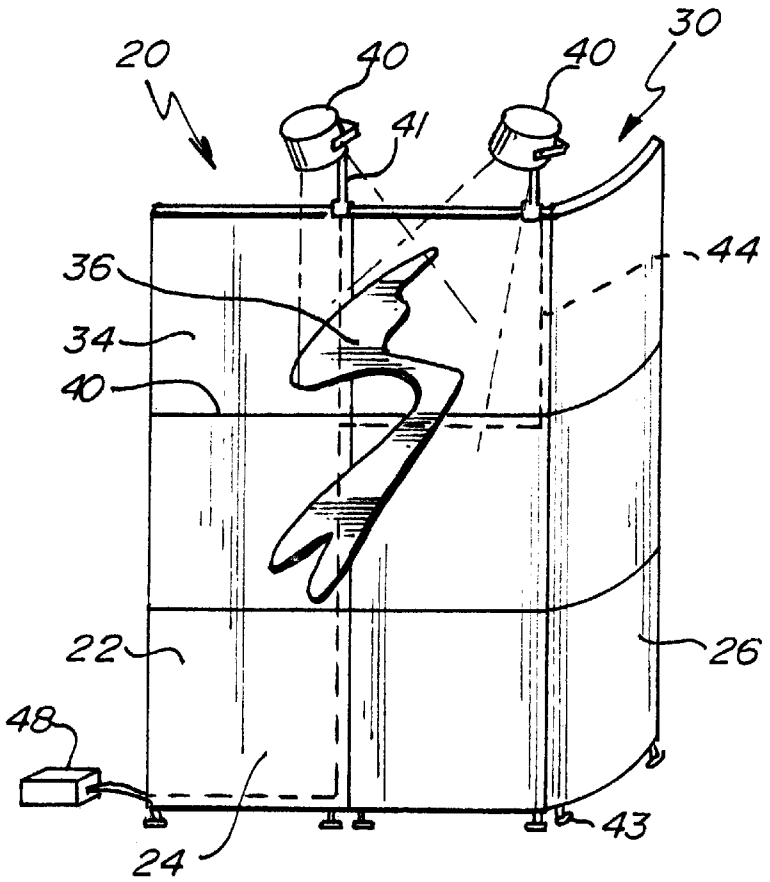
FIG. 1 is a perspective view of a display in accordance with the invention.

Referring to FIG. 1, a display system in accordance with the invention is illustrated and is designated with the numeral 20. Said display system includes a plurality of individual panels 22 which may be generally rectangular and planar in shape as indicated by the panel designation 24 or may have curved sections as represented by the panel enumerated 26. The display system is configured as a display 30 which may have a graphic design or indicia 36 as shown as FIG. 1. Such displays typically require that the juncture 40 between adjacent panels be completely closed to provide a continuous image of the graphics or indicia. The display 30 may also have powered accessories 40 illustrated as spotlights connected to or supported by the display screen 34. Such accessories require power which is provided by the electric wires 44 illustrated by the dashed lines. Such electric wires will suitably be connected to a power outlet or suitable low-voltage power supply 48.

Figure 4:
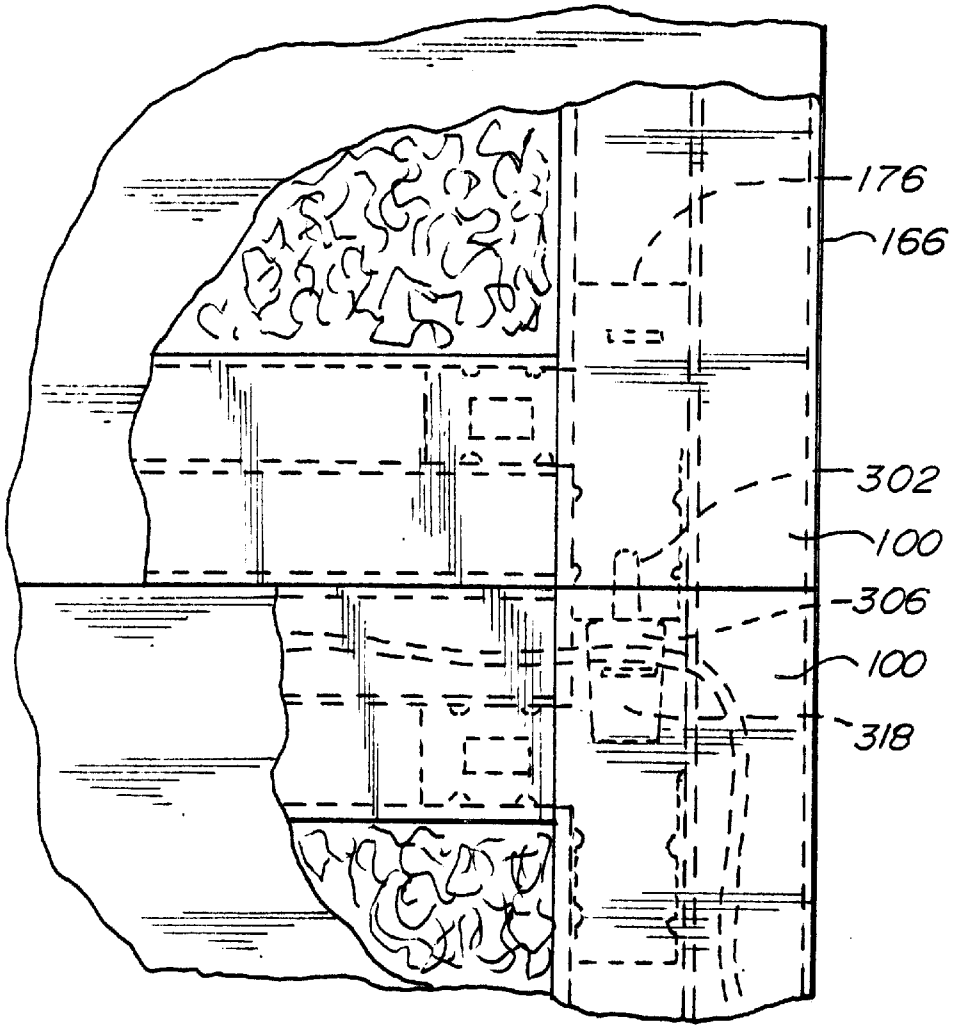
FIG. 4 is a partial sectional elevational view of the corners of a pair of adjacent panels in accordance with the invention.
Figure 2:
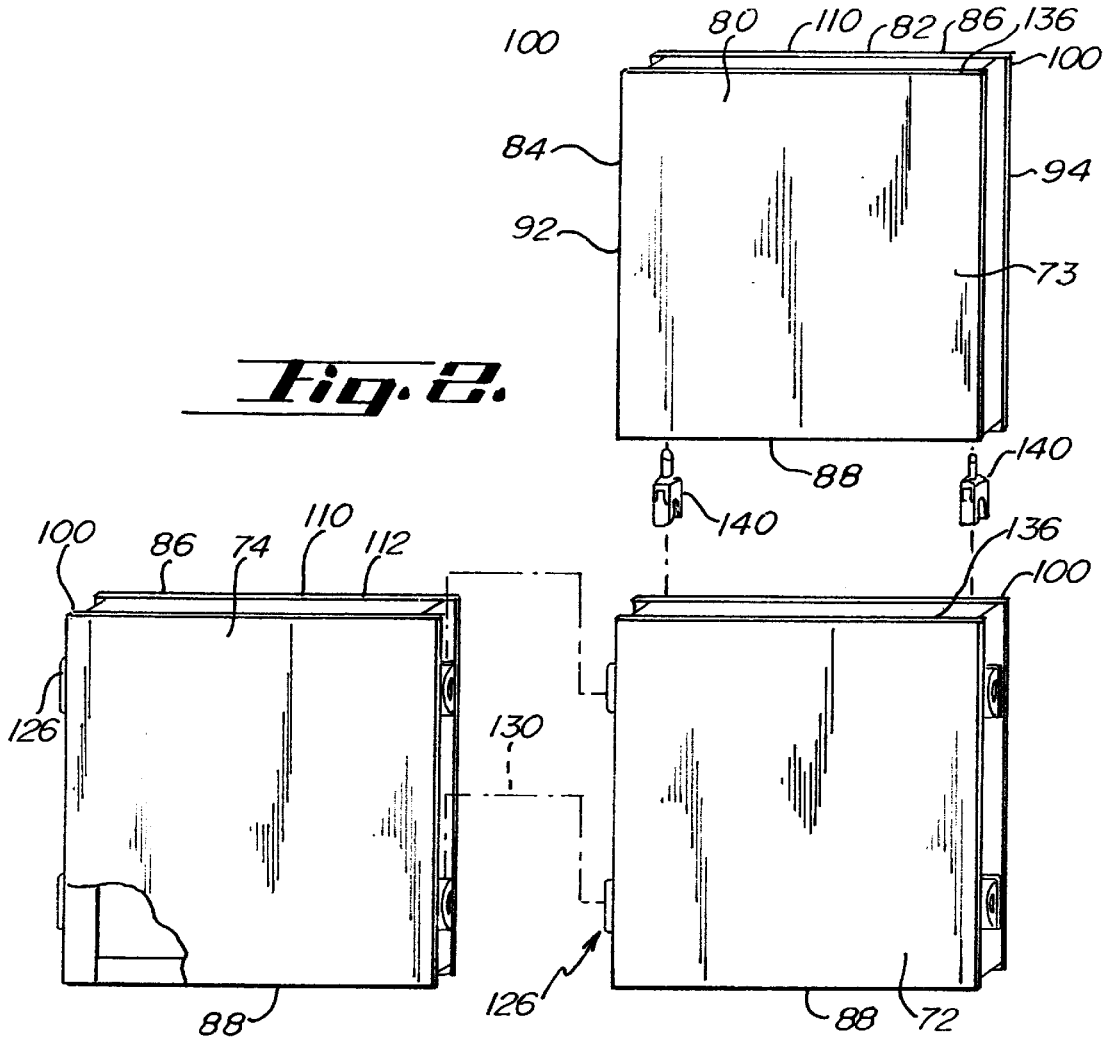
FIG. 2 is a perspective view of display panels in accordance with the invention.
Figure 3:
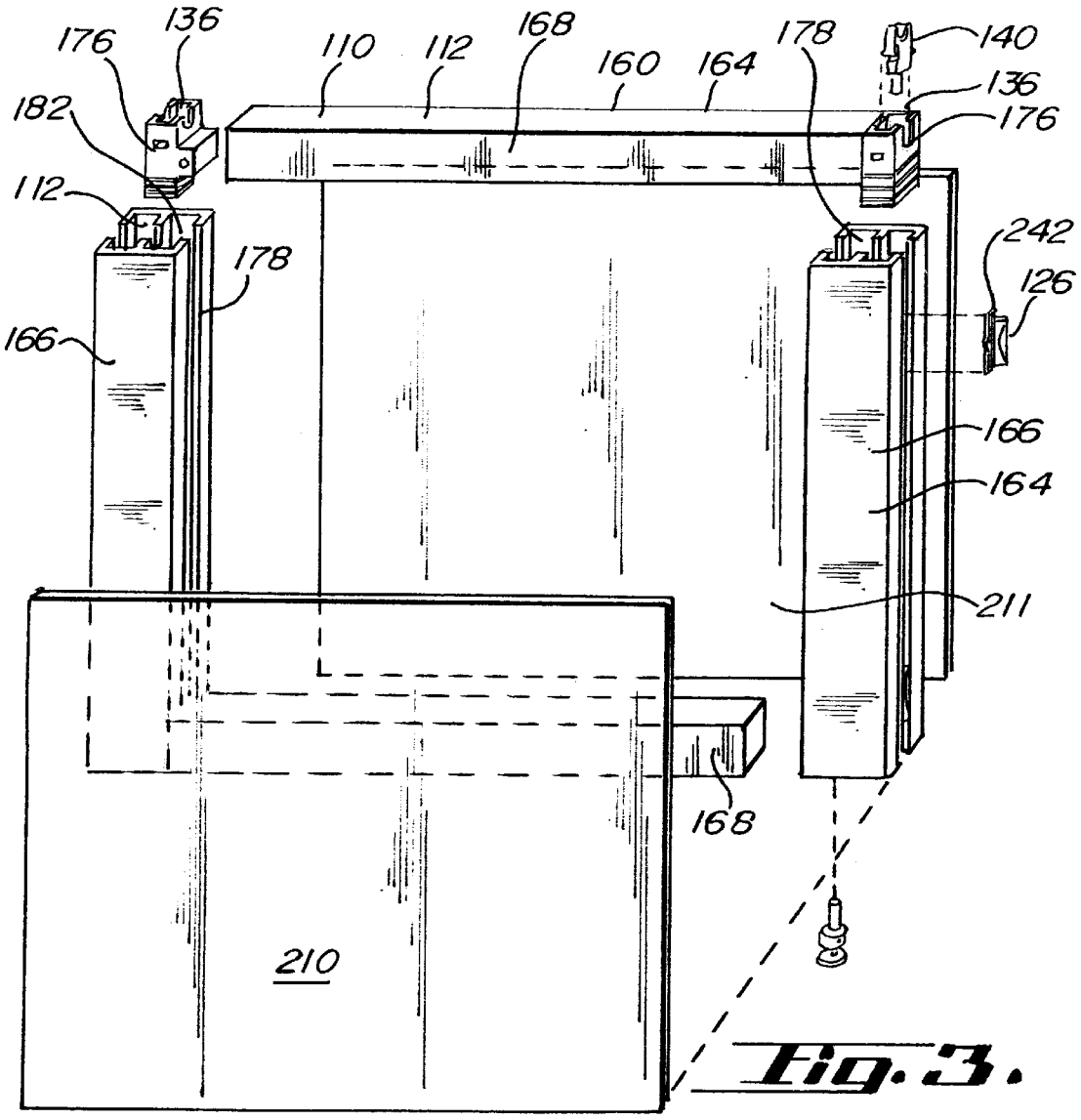
FIG. 3 is an exploded view of a display panel in accordance with the invention.

Referring to FIGS. 2, 3, and 4, various aspects of the invention are illustrated. FIG. 2 illustrates a first panel 72, a second panel 73 and a third panel 74. Each panel has a front side 80, back side 82, a periphery 84, a top horizontal edge 86, bottom horizontal edge 88, a left vertical edge 92, a right vertical edge 94, and four corners 100.

Located at the periphery or perimeter 84 of each panel is an inwardly extending and outwardly facing recess 110. Said recess is configured as an outwardly-facing channel 112. The channel includes side walls 116, 118 and a base portion 120. Positioned at the base on the left vertical edge and right vertical edge are a plurality of sliding connectors 126. These connectors engage with corresponding cooperating connectors on like edges of adjacent panels by offsetting vertically one panel next to the other panel and vertically sliding the panels into alignment as illustrated by the dashed lines of FIG. 2 with the numeral 130.

Positioned at the top horizontal edge at 86 and the bottom horizontal edge 88 are vertical connector portions 136. Vertical connector portions connect stacking connectors 140 that engage the connector portions of vertically adjacent panels such as the first and second panel of FIG. 2 to connect same together. Note that the sliding connectors 126 are illustrated as a component in FIG. 7 and is disclosed in detail in a related Provisional Application, Serial No. 60/179785, entitled Panel Display System, filed Feb. 2, 2000, and which is owned by the assignee of the instant application. Said application is hereby incorporated by reference.

The sliding connectors as shown in FIG. 2 are ideally biased to assure that the adjacent perimeters of horizontally adjacent panels are in full contact without gaps. Such bias is preferably formed by integral plastic biasing elements as With regard to the vertically stacked panels, typically gravity will tightly secure same together and preclude any noticeable gaps between adjacent panels.

Referring specifically to FIGS. 3, 4, 5, and 6, details of the construction of a panel in accordance with the invention are illustrated. The panel framework 160 is comprised of a plurality of channeled edge portions 164 including a pair of vertical channeled edge portions 166 and a pair of horizontal channeled edge portions 168. Said opposing pairs are initially secured together by way of corner components 176. Said corner components are illustrated and described in detail below.

Figure 6:
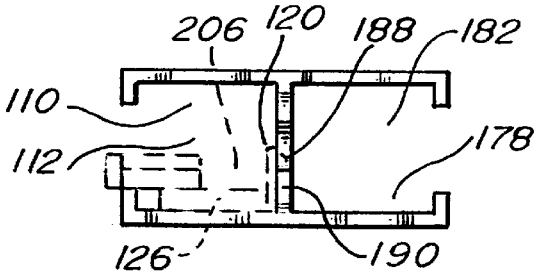
FIG. 6 is an end view of an edge portion in accordance with the invention.
Figure 4:
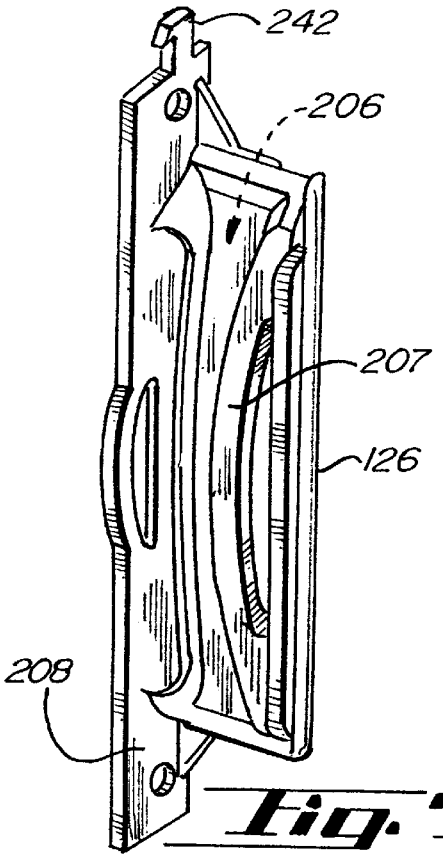
Figure 5:
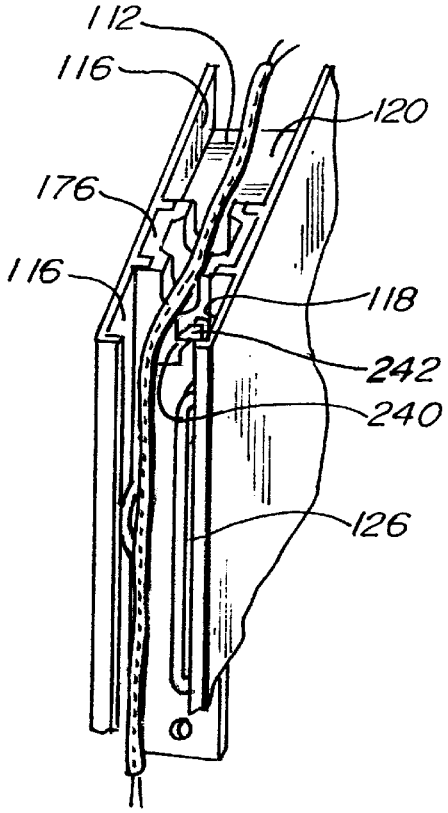
FIG. 5 is a perspective view of a corner of a display panel in accordance with the invention.

Each of the edge portions 164 has inwardly facing channels 178. The corner component engages with the recess 182 of the adjacent inwardly facing channels. The edge portions are generally configured as an I-beam as illustrated in FIG. 6. Note that there is a cut-away 188 in the I-beam cross member 190. The sliding connectors 126 are attached to the base portion 120 of the outwardly facing channel 112 as illustrated by the connector in phantom in FIG. 6 and as shown in FIG. 5. The recess 110 of the I-beam constitutes a wire conduit 200. The cut-away 188 allows the wire conduit to extend with the wire concealed through the corners 100. The sliding connectors 126, shown in isolation in FIG. 7, are suitably conformed to have an opening 206 that facilitates and continues the wire conduit past said sliding connector. Such connectors preferably have an integral plastic biasing element 207 for securing adjacent units together. The base of a preferred sliding connector is plastic and integrally formed with the biasing element. The base and biasing element may be formed of other materials, such as various metals. As such, the base 208 may be separately formed from a spring steel biasing element and secured with conventional fasteners. Alternatively, a metal spring for the biasing element may be insert molded with a plastic base. Referring to FIG. 3, the framework 160 accepts panel or sheet material 210 to cover and traverse the opening 211 defined by said framework. The external panel or sheet material may be adhered by suitable means including by use of the adhesion provided by the polyurethane injection into the core of said panels as discussed below. Alternate means for fastening suitable for particular applications would include traditional fasteners such as rivets or screws. The panels may comprise high pressure laminate commonly known as Formica or may constitute material such as fabric, sheet metal, or foils. In certain embodiments no external panel or sheet material may be utilized and the panel may be formed with the fill material in the interior of the framework exposed. This type of configuration is suitable where differently colored exterior panels may stocked and may be attached to stockpiled display units as necessary for customer orders.

Figure 8:
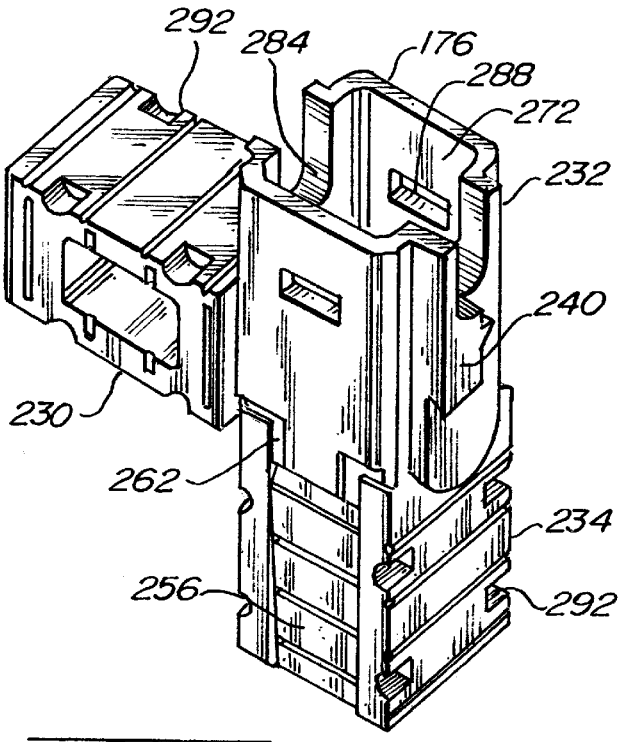
FIG. 8 is a perspective view of a corner connector component in accordance with the invention.
Figure 9:
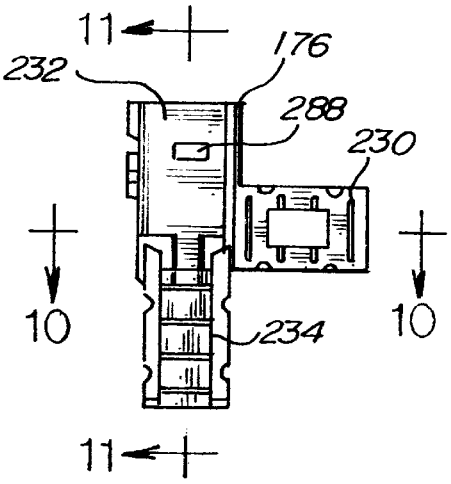
FIG. 9 is an elevational view of a corner connector in accordance with the invention.
Figure 10:
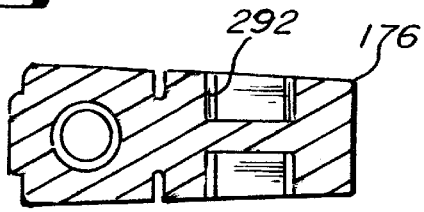
FIG. 10 is a cross-sectional view taken at line 10—10 of FIG. 9.
Figure 11:
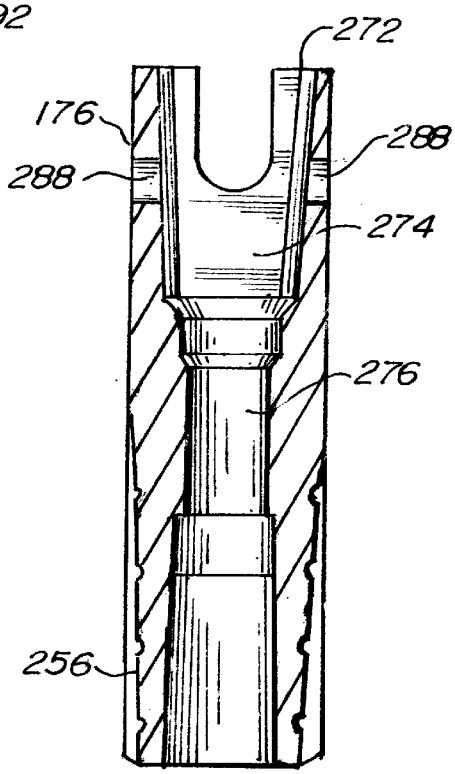
FIG. 11 is a cross-sectional view at line 11—11 of FIG. 9.

Referring to FIGS. 8, 9, 10, and 11, details of the corner component are illustrated. The corner component is generally T-shaped as shown in FIG. 8 with a lower leg 230 and a pair of aligned legs 232, 234. As shown a first leg or lower leg 230 is sized for insertion into the recess 110 defined by the inwardly facing channel of the upper and lower horizontal channeled edge portions 168, not shown in this view. The aligned second legs or upper legs 234 of the T-shaped corner component 234 are inserted into each end of the inwardly facing channel of the vertical channeled edge portions 166. The corner connectors have several significant structural features as follows. A hook member 240 is configured to engage, lock and position a sliding connector 126 at the corresponding hook 242 of said connector. The interior second leg 234 includes an interior tapered portion 256 which helps define a tortuous air vent 262 that allows the injection of and/or expansion of the fill material, i.e. polyurethane foam, up to the corner piece and allows the escape of the displaced air but effectively clogs when the polyurethane reaches said tortuous air vent 262. The exterior third leg 232 of the corner portion includes a receptacle 272 for receiving plug-in components 280 which may comprise stacking connectors 140 or accessory connectors 41, or feet 43 as shown in FIG. 1. Said receptacle includes a first receiving region 274 and a second receiving region 276. The plug-in components may have male portions to engage one or both of the receiving regions. The exterior leg 232 of the corner component has cut-away portions 284 configured as U-shaped openings which define the wire conduit passing therethrough. The legs that engage with the inwardly facing channels of the edge portions, that is legs 230, 232 also have structural features 292, such as notches 293 and recesses 294, which facilitate gripping of the respective edge portions as well as facilitating receiving injected polyurethane at the interfaces between the corner connector components 174 to provide and effect adhesion between said corner connectors and the respective edge portions.

Figure 12:
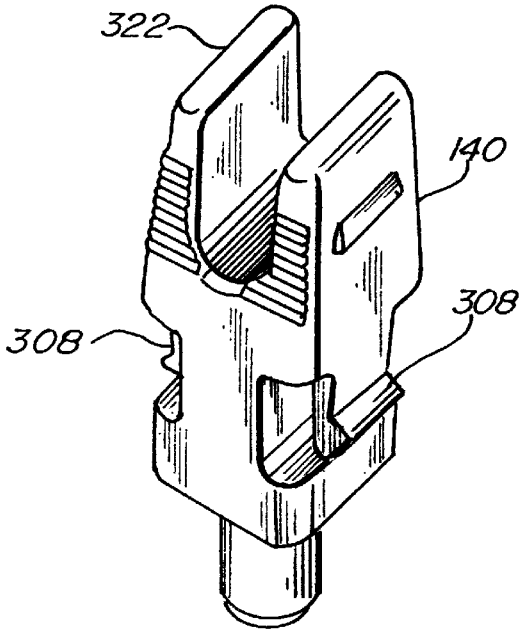
FIG. 12 is a perspective view of a vertical stacking connector in accordance with the invention.
Figure 13:
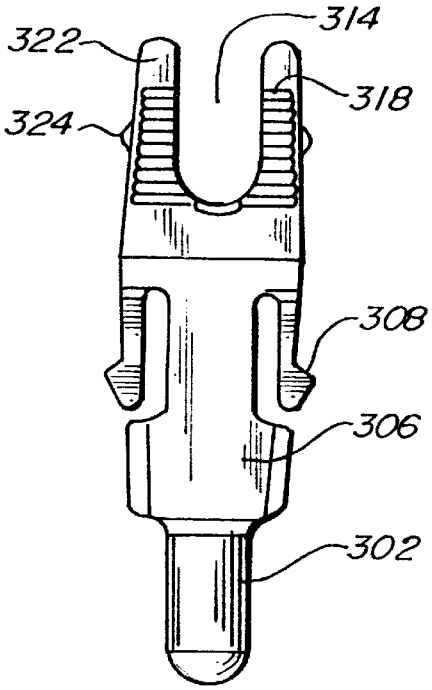
FIG. 13 is an elevational view of the connector of FIG. 12.

Referring to FIGS. 12 and 13, a plug-in component configured as a vertical stacking connector 140 is shown. Said stacking connector has a reduced diameter plug portion 302 which is received in the second receiving region 276 of the reciprocal 272 of the corner component. A wider diameter plug portion 306 extends into the first receiving region 274 of said reciprocal. Detents 308 operate to secure the plug-in component in said receptacle and thus in the panel of which the corner component is part. The plug-in component has an opening 314 configured in a U-shape that defines a wire conduit. Such U-shaped opening preferably has a diameter of 0.25 inches which facilitates power lines of 120 volts. Where low voltage accessories are utilized the diameter of the wire management openings may be reduced. The outer portion 318 of the stacking connector is configured to be received within the reciprocal of the corner connector of a panel, that is adjacent to the panel that the reduced diameter plug portion and second plug portion 306 are engaged with. Said U-shaped facilitates the wire conduit as well as providing some flex to the finger portion 322 which include detents 324. The plug-in components can utilize various other configured upper portions that, for example, would not plug in to an adjacent panel but rather would attach to or be part of an accessory such as the spotlights 40 shown in FIG. 1.

The corner connectors are preferably formed of die-cast zinc or zinc alloy, but may also be formed of other materials such as glass or fiber-filled nylon. Similarly, the plug-in components may be die-cast or made of glass or fiber-filled nylon or other thermoplastics.

The air vent 262 having the tortuous path, may have various is configurations. As illustrated, it may be formed by structure in the corner component. Referring to FIG. 4, alternate vents such as use of plugs 335 in apertures 336 formed of sintered beads. The important characteristic of the vent is that it is substantially pervious to the escape of air from the filling or expanding of the fill material and is substantially impervious to the passage of the fill material.

Figure 14:
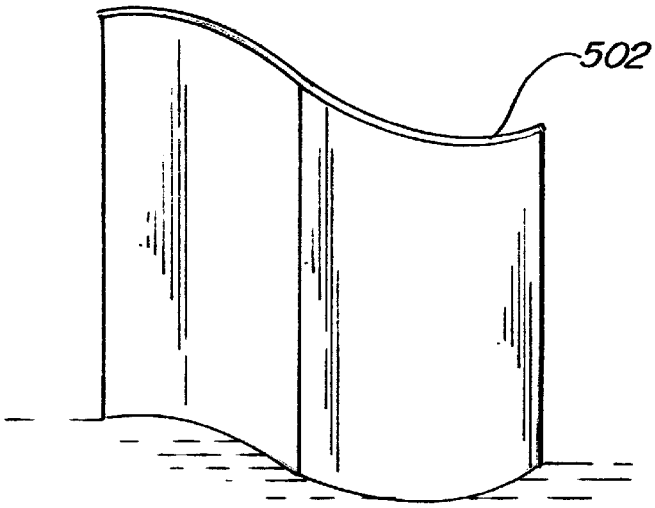
FIG. 14 is a perspective view of an alternative display in accordance with the invention.
Figure 15:
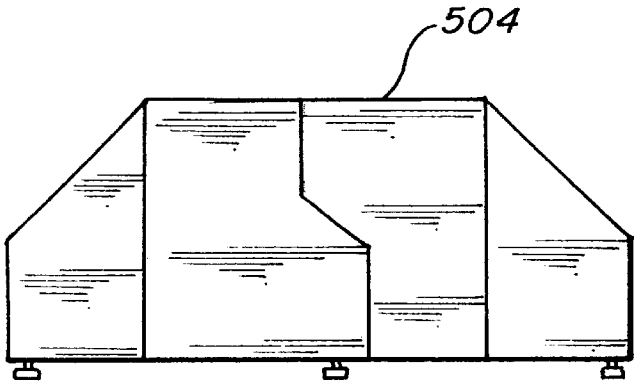
FIG. 15 is an elevation perspective view of an alternative display in accordance with the invention.
Figure 16:
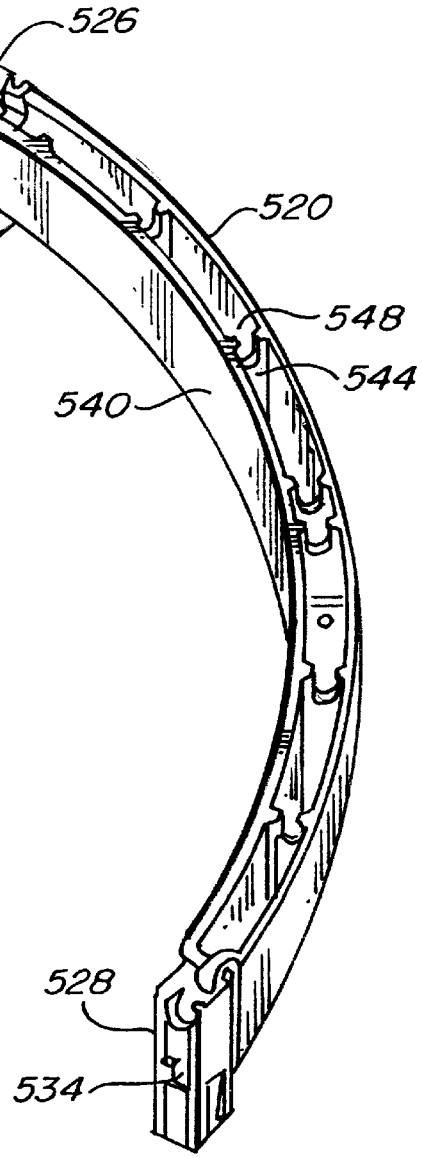
FIG. 16 is a perspective view of a curved connector portion in accordance with the invention.

Referring to FIGS. 14 and 15, two additional portable displays 502, 504 are illustrated. These displays include non- rectangular and non-planar individual display panels. Such panels are constructed and configured to include the inventive aspects described herein. FIG. 16 illustrates a curved connector portion 520, suitable for use in the curved panel section of FIG. 14. Such a curved connector portion may preferably be unitarily formed by injection molding of thermoplastic material. The component includes two corner connector portions 526, 528 generally have the features of the corner connectors described above. Specifically cutaway portions 530 which provide the wire management aspect of the invention are provided as well as structure 534 to provide a tortuous vent. The edge portion 540 may be channel shaped and has a plurality of intermediate structural supports 544 each which has wire management openings 548. Such structural supports provide strength and rigidity to the component.

Figure 17:
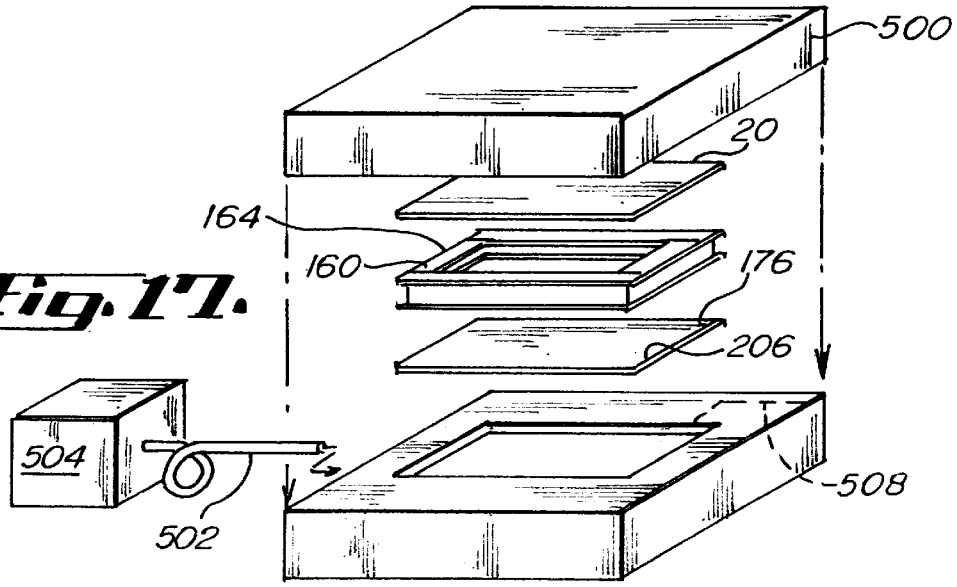
FIG. 17 is a perspective view of a molding arrangement for producing display panels in accordance with the invention.

Referring to FIG. 17, a generic press 500 is illustrated to aid in description of the methodology of forming the panels. The framework 160, including the edge portions 164 and the corner components 176, are placed in a press with the paneler sheet members 206 if desired. The press is closed and polyurethane expanding foam is injected by a tool 502 from a supply source 504. The foam core is allowed to cure sufficiently to avoid any further expansion and is then removed from the press. The injection tool 502 may be suitably through an aperture in one of the edge portions. During said injection, appropriate vents 508 are provided in the press and are ideally located at the corners such that air that passes through the tortuous air vent at the corner connector components 176 may be readily discharged.

The skilled person will appreciate that variation of the disclosed arrangements are possible without departing from the invention. Accordingly, the above description of several embodiments is made by way of example and not for the purposes of limitation. It will be clear to the skilled person that minor modifications can be made to the method without significant changes to the operation described above. The present invention is intended to be limited only by the spirit and scope of the following claims.

This application is related to the Application with the same inventors filed on even date with this application, and entitled Panel Display System. Said application is incorporated by reference.

We claim:

1. A portable display system with wire management, the display system comprised of a plurality of rectangular display panels assembleable and disassembleable and including a first display panel and a second display panel, each display panel having a front side, a back side, four corners, a perimeter with a top horizontal edge, a bottom horizontal edge, a left vertical edge, a right vertical edge, each of said first and second display panels having a panelar sheet spanning the front side of said display panels and extending to the perimeters of said first and second display panels;

the first display panel and the second display panel directly abutting and coupled one on top of the other, at least one removeable connector extending vertically between the first and second display panels coupling said top horizontal edge of the first display panel to the bottom horizontal edge of the second display panel, a channel extending along at least one of said top horizontal edge of the first display panel and said bottom horizontal edge of the second display panel, said channel defining a horizontal wire conduit, said at least one display panel connectors extending vertically between said first and second display panels and positioned within said channel, the connector having a wire conduit opening extending horizontally thereby continuing the wire conduit past said at least one connector whereby the wire conduit runs from the right vertical edges to the left vertical edges of the first and second display panels; and a wire for providing power extending down said horizontal wire conduit and through said wire conduit opening in the connector, the wire being concealed within said horizontal wire conduit.

2. The display system of claim 1 further comprising a third display panel connected horizontally adjacent to and abutted against one of said first and second display panels that are coupled one on the top of the other, at least two connectors vertically spaced from one another extending horizontally between said third panel and said one of said first and second panels, a channel extending along the vertical edge of at least one of said third panel and said one of said first and second panels defining a vertical wire conduit, each of said two connectors having a vertically extending opening whereby the vertical wire conduit continues therethough the wire extending through the vertical wire conduit and past said two connectors, the wire being concealed therein.

3. The display system of claim 2 wherein the first display panel, second display panel, and the third display panel meet at a corner juncture and wherein the vertical wire conduit is in communication with the horizontal conduit at the corner juncture thereby providing a wire conduit extending vertically and horizontally and wherein the wire extends vertically and horizontally therethrough, the wire is concealed therein.

4. A portable display comprised of a plurality of display panels each with a front side, a back side and a plurality of edges, the plurality of edges normally positioned with respect to the front side and back side, the display panels coupled and directly abutted together at their plurality of edges by a plurality of connectors, said edges having a wire conduit extending therein, said connectors extending from said edges for removable connection of adjacent panels in a directly abutting relationship, said connectors having wire conduit openings extending therethrough whereby wires may be run intermediate and conceal within coupled and directly abutted panels, and past the each of the plurality of connectors extending between said coupled and directly abutted panels, the system further comprising a powered accessory mounted on the display, and wire for providing power to the powered accessory, the wire extending through the wire conduits within the display to the powered accessory whereby the wire is concealed within said display.

5. A display system comprised of a plurality of rectangular shaped panels each of which has a front side, a back side, and four edges, the panels coupleable and directly attributable together at their edges forming a display with, each panel having a top edge, a bottom edge, a left edge and a right edge defining a periphery, panelar sheet spanning the front side of each panel and extending to the periphery of each of said panels, at least one edge of each panel having a recess extending inwardly into said edge and extending the length of said edge and defining a wire conduit, whereby the recess is exposed substantially the length of said edge when the panel is not coupled with another panel at said edge and whereby said recess is substantially concealed the length of said edge when the panel is coupled with another panel at said edge, a wire providing power to a powered accessory, the wire placeable in the recess thereby concealing the wire when the panel is coupled with another panel.

6. The display system of claim 5, wherein each panel couples with another panel at the edge with recess by way of a plurality of connectors extending between said panels, and wherein said connectors extend within said recess, whereby when said edge of said panel is not coupled with another panel, said plurality of connectors are exposed and whereby when said edge of said panel is coupled with another panel, said connectors are concealed from the front side and the back side.

7. The display system of claim 6 wherein each of said connectors has an opening whereby said wire conduit is continued past said connector.

8. The display system of claim 6 wherein the recess defines a channel with a interior width and wherein the wire conduit has a diameter and said diameter is at least ⅕ the width of channel along the length of said recess.

9. A display system comprising a plurality of rectangular panels, each panel having a front side surface, a back side surface and two pairs of opposite edges, the edges perpendicularly oriented with respect to the front side surface and back side surface, the edges coupleable in a directly abutting arrangement with like edges of other of said plurality of panels, one of said pairs of edges having a plurality of sliding connectors that couple like edges together by sliding at least one of said edges in a direction parallel to said edge, each of said sliding connectors having a wire conduit opening, the other of said pairs of opposite edges coupleable with like edges of other of said plurality of panel by sliding in a direction perpendicular to said edge, at least one edge of each of said pairs of opposite edges having a wire conduit extending along each said respective edges and wherein each of said wire conduits are partially defined by a recess within said respective edges, the system further comprising a powered accessory and a wire for providing power, the wire placeable in the wire conduits thereby concealing the wire from view, and the powered accessory mountable on a panel.

10. A display system with wire management, the display system comprised of a plurality of rectangular display panels removeably connected together in rows and columns, each display panel having a front side, a back side, four corners, a perimeter with a top horizontal edge, a bottom horizontal edge, a left vertical edge, a right vertical edge, each panel comprising:

a) a pair of vertical channeled edge portions positioned at the left vertical edge and the right vertical edge of each display panel, each edge portion having an outwardly facing channel, an inwardly facing portion;

b) a pair of horizontal channeled edge portions positioned at the top horizontal edge and bottom horizontal edge of each display panel, each channeled edge portion having an outwardly facing channel and an inwardly facing channel, c) a plurality of corner components, each positioned at a corner, each right angle corner component fastened onto a horizontal channeled edge portion and a vertical channeled edge portion, whereby the horizontal channeled edge portions, the vertical channeled edge portions, and the right angle corner components, form a rectangular framework for the display panel;

d) a rectangular panelar sheet spanning the front of each display panel and rectangular framework, the panelar sheet, the channeled horizontal portions, the channeled vertical edge portions, and the plurality of corner components adhered together;

e) a plurality of vertical stacking connectors for removeable connecting between vertically stacked display panels, each vertical stacking connector having an opening defining a wire conduit extends therethrough, each vertical stacking connector allowing adjacent horizontal channeled edge portions of adjacent stacked display panels to abut against one another whereby a wire conduit extending along and inside of each of the outwardly facing channels, at least one of the corners having an opening extending between the outwardly facing channel of the spective vertical channeled edge portion and the outwardly facing channel of the respective horizontal channeled edge portion at said corner, whereby wire may be run unexposed horizontally between said panel and a vertically joined panel and vertically between said panel and a horizontally joined panel; and a plurality of horizontal connectors for removeably connecting between horizontally adjacent display panels, the horizontal connectors having an opening defining a wire conduit extending therethrough each horizontal connector.

11. The display system of claim 10, wherein each of the channeled edge portions have a recess inwardly positioned with respect to the outwardly facing channel, the inwardly facing recess sized and positioned for engagement with a respective corner component.

12. The display system of claim 11, wherein each of the inwardly positioned recesses of the vertical channeled portions comprise an inwardly facing channel and wherein each of the corner components comprises a vertically extending portion sized to fit the inwardly facing channel of the respective vertical channeled portion.

13. The display system of claim 11, wherein each of the inwardly positioned recesses of the horizontal channeled portions comprise an inwardly facing channel and wherein each of the corner components comprises a horizontally extending portion sized to fit the inwardly facing channel of the respective horizontal channeled portion.

14. The display system of claim 10 wherein each vertical stacking connector has two ends and each end connectable to corner components of the display panels and wherein at least one connector end of each panel stacking connector display system further comprises a U-shaped portion to preserve the wire conduit at the corner portion where the stacking connector is used.

* * * * *